US009725856B2

(12) United States Patent
Povoli

(10) Patent No.: US 9,725,856 B2
(45) Date of Patent: Aug. 8, 2017

(54) COVER FOR A CONCRETE PARKING BLOCK

(71) Applicant: Alexander Povoli, Jacksonville, FL (US)

(72) Inventor: Alexander Povoli, Jacksonville, FL (US)

( * ) Notice: Subject to any disclaimer, the term of this patent is extended or adjusted under 35 U.S.C. 154(b) by 0 days.

(21) Appl. No.: 14/919,785

(22) Filed: Oct. 22, 2015

(65) Prior Publication Data

US 2016/0040376 A1 Feb. 11, 2016

Related U.S. Application Data

(63) Continuation-in-part of application No. 14/302,619, filed on Jun. 12, 2014, now abandoned.

(60) Provisional application No. 61/843,178, filed on Jul. 5, 2013.

(51) Int. Cl.
*E01F 15/04* (2006.01)
*E01F 9/588* (2016.01)
*E01F 9/08* (2006.01)

(52) U.S. Cl.
CPC ..... *E01F 9/588* (2016.02); *E01F 9/083* (2013.01)

(58) Field of Classification Search
CPC ..... E01F 13/00; E01F 15/00
USPC ..... 404/6, 7, 8, 9
See application file for complete search history.

(56) References Cited

U.S. PATENT DOCUMENTS

| | | | | |
|---|---|---|---|---|
| 2,116,426 A * | 5/1938 | Cecil | E01C 13/00 | 256/1 |
| 2,841,059 A * | 7/1958 | Wiswell | E01F 9/588 | 404/13 |
| 3,788,001 A * | 1/1974 | Balfanz, Jr. | A01G 1/08 | 404/7 |
| 4,035,059 A * | 7/1977 | DeMaster | G02B 5/128 | 359/538 |
| 4,142,814 A * | 3/1979 | Sanchez | E01F 9/588 | 256/1 |
| 4,321,769 A * | 3/1982 | Tisbo | A01G 1/08 | 47/33 |
| D458,177 S * | 6/2002 | Spiller | D10/113.3 | |
| D460,013 S * | 7/2002 | Spiller | D10/113.3 | |
| D461,138 S * | 8/2002 | Spiller | D10/113.3 | |
| 6,887,011 B2 * | 5/2005 | Snagel | E01F 9/553 | 359/551 |

(Continued)

FOREIGN PATENT DOCUMENTS

JP 2005330722 A * 12/2005

*Primary Examiner* — Thomas B Will
*Assistant Examiner* — Katherine Chu

(57) ABSTRACT

A cover for a concrete parking block has a first lateral end, second lateral end and a longitudinal enclosure. The first lateral end and the second lateral end can be either open or closed. The longitudinal enclosure is the same length as the concrete parking block. The protective cover can be made of high-density polyethylene (HDPE), Thermoplastic polyolefin (TPO), Acrylonitrile Butadiene styrene (ABS) or foam and resin. The protective cover can also be used to as a bicycle stand. In doing so, the bicycle wheels are inserted into V-shaped slots of the longitudinal enclosure. A water bladder is attached to the protective cover when used as a bicycle stand. A reflective coating is applied on the exterior of the protective cover in order to provide more visibility during low light conditions.

11 Claims, 15 Drawing Sheets

(56) References Cited

U.S. PATENT DOCUMENTS

| | | | | |
|---|---|---|---|---|
| 7,186,053 | B2 * | 3/2007 | Detzel | E01F 9/529 404/71 |
| 7,997,823 | B2 * | 8/2011 | Meyers | E01F 15/003 404/6 |
| 2006/0239775 | A1 * | 10/2006 | Klassen | G09F 23/00 404/7 |

* cited by examiner

COVER FOR A CONCRETE PARKING BLOCK

The current application is a continuation-in-part (CIP) application of a U.S. non-provisional application Ser. No. 14/302,619 filed on Jun. 12, 2014. The U.S. non-provisional application Ser. No. 14/302,619 claims a priority to a U.S. provisional application Ser. No. 61/843,178 filed on Jul. 5, 2013.

FIELD OF THE INVENTION

The present invention relates generally to the field of protective covers that can be used on a concrete parking block. The present invention protects the concrete parking block from vehicle-related damage and from weather-related damage.

BACKGROUND OF THE INVENTION

The large number of automobiles has increased the demand for parking lots and parking garages. Parking garages and parking lots generally include a large number of parking spaces with these parking spaces marked with lines to define the boundaries. However, due to space restrictions a large number of parking spaces are located in close proximity. Therefore, an additional means to notify the drivers of the parking space boundary is necessary. Concrete parking blocks have proven to be the most effective method of notifying a driver. These concrete parking blocks make constant contact with automobiles. Drivers also have the tendency to run into the concrete parking blocks especially in low light conditions such as night time. As a result, the concrete parking blocks are damaged after a certain time period. In addition, concrete parking blocks are exposed to different weather conditions. The exposure results in weather related chips and cracks on the surface of the concrete parking blocks. Maintaining and repairing a large number of parking blocks is not a practical solution. The lack of maintenance can result in causing damage to automobiles and also individuals. Furthermore, replacing a large number of concrete blocks may require a considerable financial investment.

The objective of the present invention is to address the aforementioned issues. In particular, the present invention introduces a convenient, effective, and practical solution to protect a concrete parking block. The present invention is a cover that can be used on a concrete parking block. The cover is produced of material that is not biodegradable and also durable. The present invention ensures that the concrete parking blocks are protected against vehicle-related damage and weather related damages. Traditional concrete parking blocks are not clearly visible during low light conditions. The present invention allows a concrete parking block to be more visible in such low light conditions. More specifically, the outer surface of the present invention is coated with phosphorescent material for visibility at night. Additionally, the present invention can be coated with fluorescent material to provide better visibility during the day. The effective design also allows the concrete parking block cover to serve as a bicycle rack. The durability of the present invention eliminates the need of repairing, which is financially advantageous.

DETAIL DESCRIPTIONS OF THE INVENTION

All illustrations of the drawings are for the purpose of describing selected versions of the present invention and are not intended to limit the scope of the present invention.

The present invention is a protective cover that can be used on a concrete parking block 100. By utilizing the present invention, a concrete parking block 100 can be protected from vehicle related damages, weather related damages, and damages caused by continuous use. Due to the effective design of the present invention, the protective cover can also be used on a concrete parking block 100 with a different cross-sectional shape.

Figure 1:
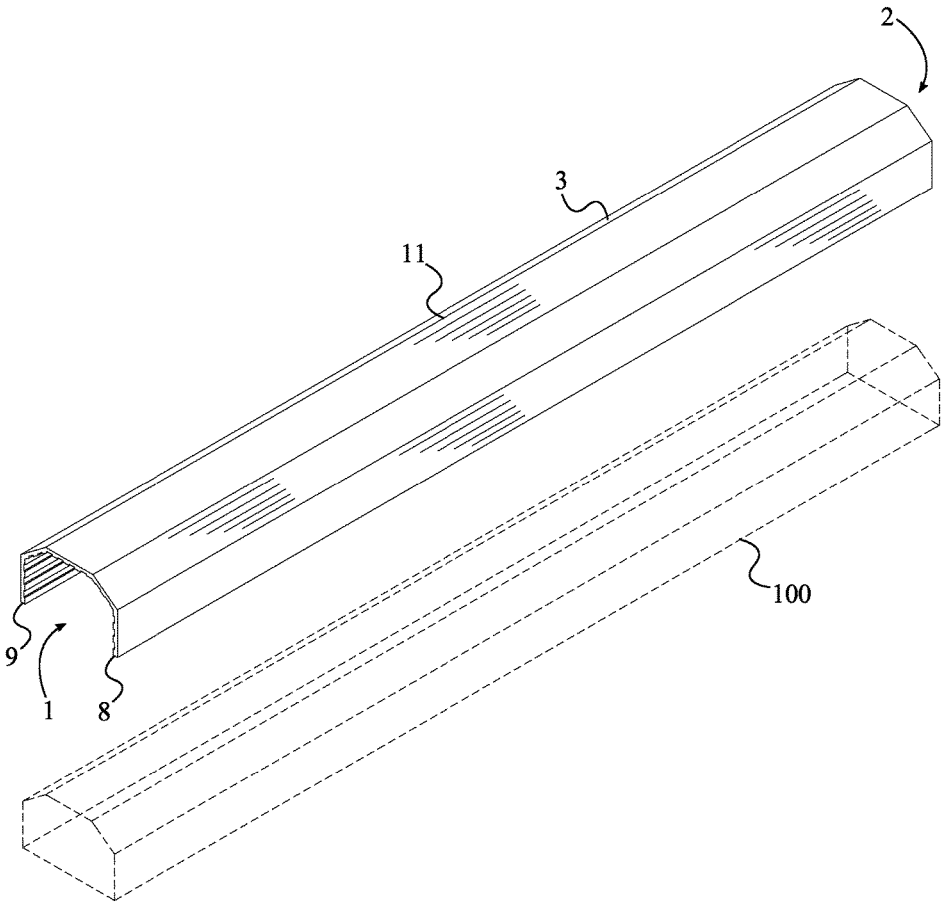
FIG. 1 is an isometric exploded view of the first embodiment of the present invention and a parking block.
Figure 2:
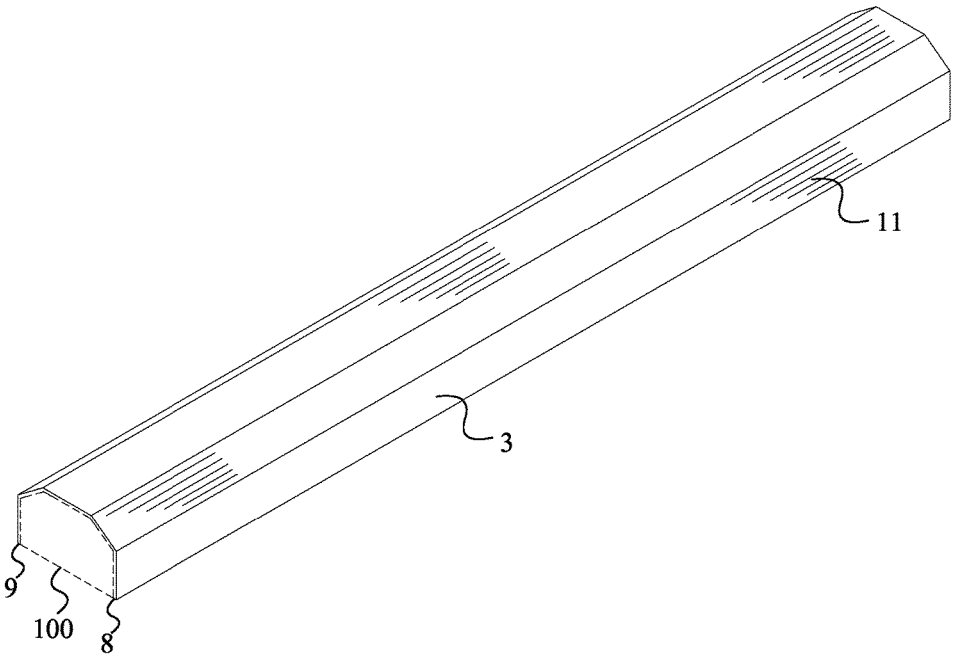
FIG. 2 is an isometric view of the first embodiment of the present invention attached to a parking block.
Figure 5:
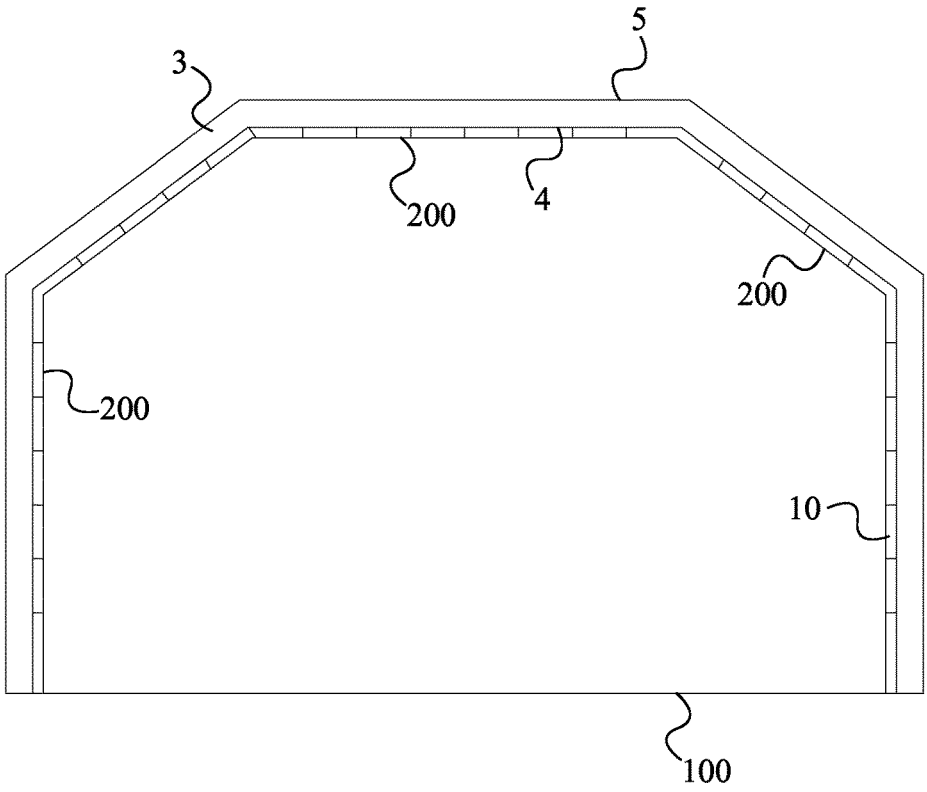
FIG. 5 is a cross sectional view of the present invention attached to a parking block.
Figure 6:
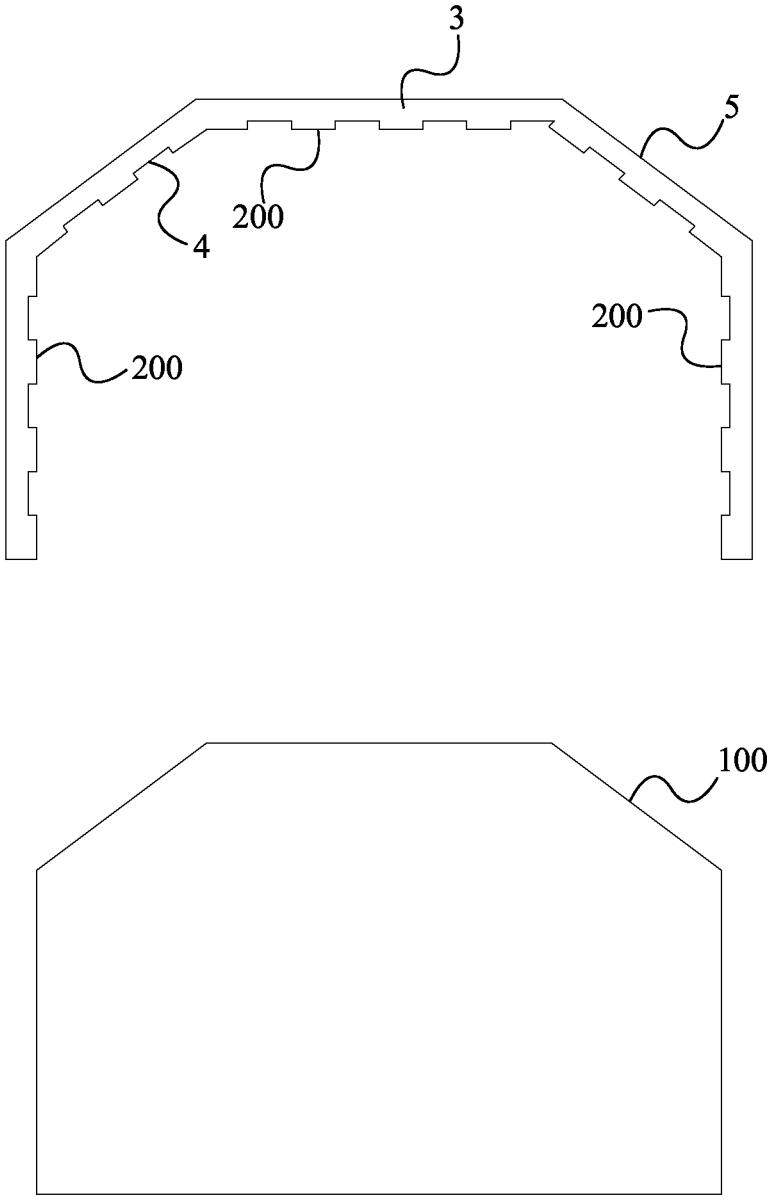
FIG. 6 is an exploded side view of the present invention and the concrete parking block.
Figure 7:
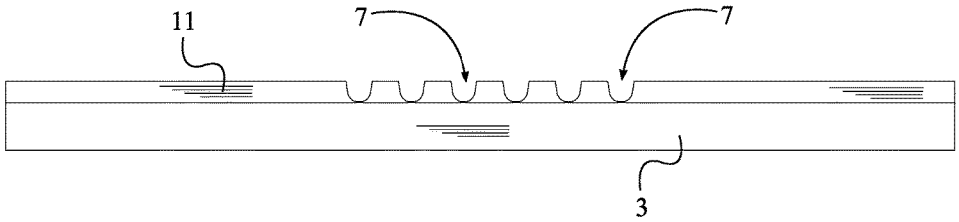
FIG. 7 is a side view of the present invention, wherein the present invention encloses a water bladder.

As seen in FIG. 1 and FIG. 5, the present invention comprises a first lateral end 1, a second lateral end 2, a longitudinal enclosure 3, and a parking block adhesive 10. The first lateral end 1 and the second lateral end 2 are positioned opposite to each other along the longitudinal enclosure 3. The first lateral end 1 and the second lateral end 2 are used to protect the sides of the concrete parking block 100. The longitudinal enclosure 3 comprises an inner surface 4, an outer surface 5, a first contact edge 8, and a second contact edge 9. When utilized on the concrete parking block 100, the first lateral end 1 and the second lateral end 2 correspond to the lengthwise boundaries of the concrete parking block 100. The longitudinal enclosure 3 is the same length as the concrete parking block 100. The longitudinal enclosure 3 is perimetrically connected around the first lateral end 1. As a result, the longitudinal enclosure 3 and the first lateral end 1 are able to brace against an end of the concrete parking block 100 as illustrated in FIG. 2. Similarly, the longitudinal enclosure 3 is perimetrically connected around the second lateral end 2. As a result, the longitudinal enclosure 3 and the second lateral end 2 are able to brace against the opposite end of the concrete parking block 100. Furthermore, the longitudinal enclosure 3 is perimetrically connected around the first lateral end 1 and the second lateral end 2 from the first contact edge 8 to the second contact edge 9. Therefore, when the present invention is used on the concrete parking block 100, the first contact edge 8 and the second contact edge 9 make contact with the surface that the concrete parking block 100 is installed on. The present invention is attached to the concrete parking block 100 utilizing a parking block adhesive 10. The utilized parking block adhesive 10 can be, but is not limited to, caulking or liquid nails. In order to secure the present invention against the concrete parking block 100 the present invention utilizes a plurality of protrusions 200 as seen in FIG. 5 and FIG. 6. The plurality of protrusions 200 is positioned along the longitudinal enclosure 3 such that the present invention has a uniform connection throughout the length of the longitudinal enclosure 3. As seen in FIG. 6, the plurality of protrusions 200 is connected adjacent and across the inner surface 4. Therefore, when mounting the present invention onto the concrete parking block 100, the parking block adhesive 10 is layered across the inner surface 4 and amongst the plurality of protrusions 200. Resultantly, the present invention establishes a secure connection with the concrete parking block 100.

As seen in FIG. 1, in the first embodiment of the present invention, the first lateral end 1 and the second lateral end 2 are open. When the present invention is utilized on the concrete parking block 100, the lengthwise ends of the concrete parking block 100 are not covered. More specifically, only the longitudinal enclosure 3 makes contact with the concrete parking block 100. The length of the longitudinal enclosure 3 is such that the entire length of the concrete parking block 100 is covered.

Figure 3:
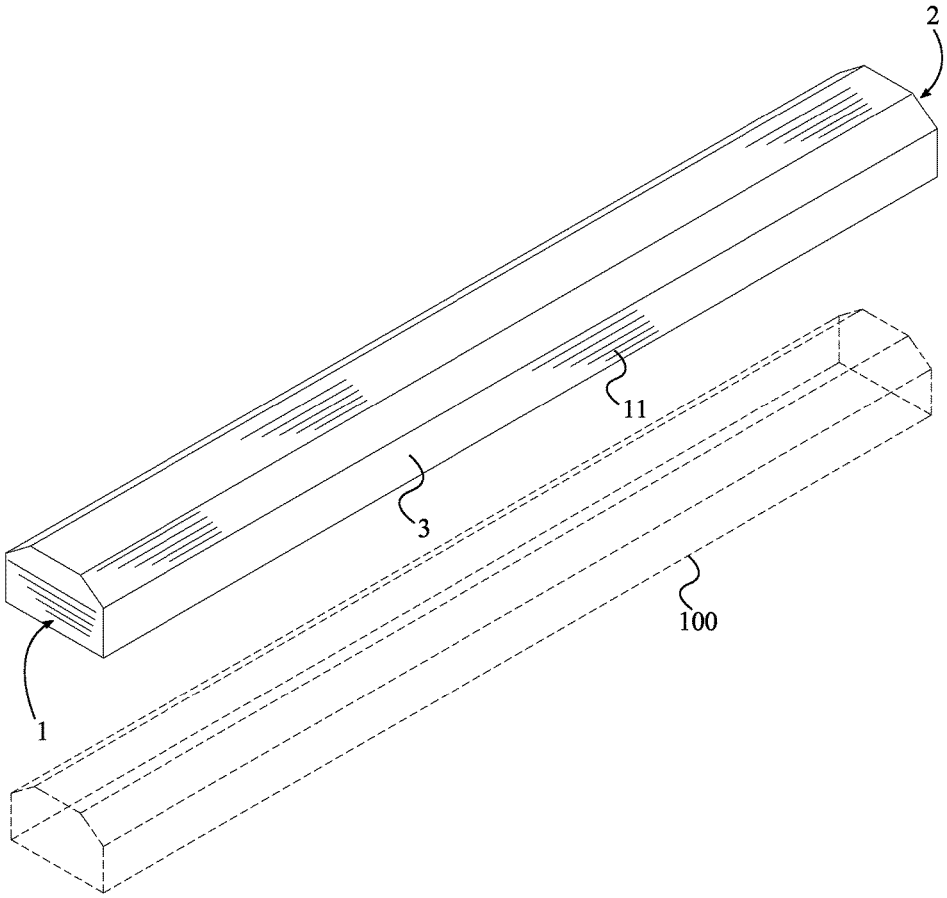
FIG. 3 is an isometric exploded view of the second embodiment of the present invention and a parking block.
Figure 4:
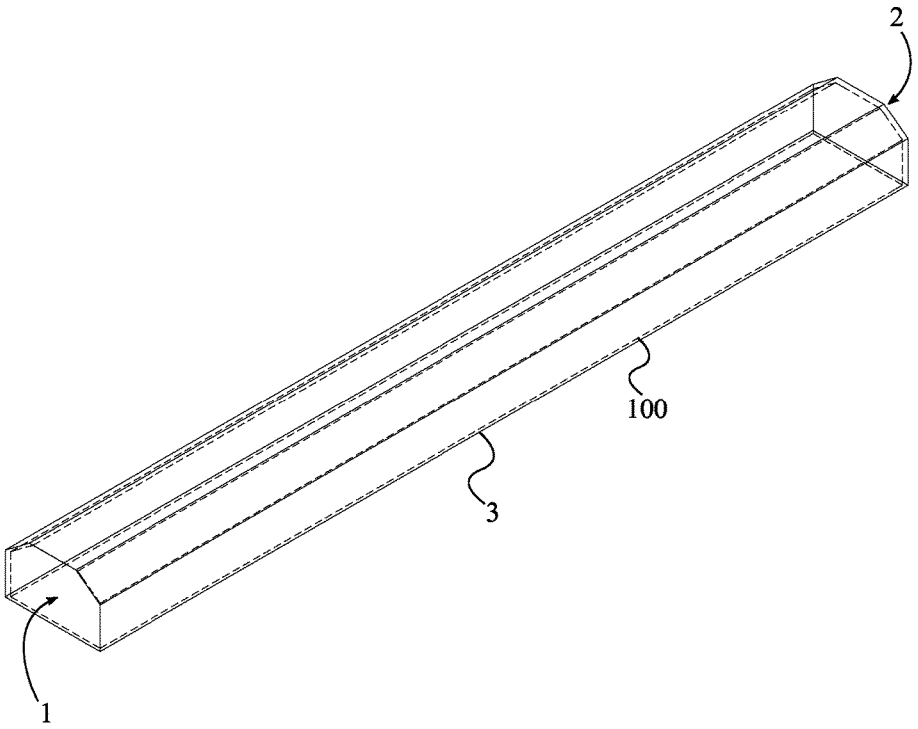
FIG. 4 is an isometric view of the second embodiment of the present invention attached to a parking block.

As seen in FIG. 3, in the second embodiment of the present invention, the first lateral end 1 and the second lateral end 2 are closed ends. As a result, when the present invention is utilized on a concrete parking block 100, the inner surface 4 of the longitudinal enclosure 3, the first lateral end 1, and the second lateral end 2 each make contact with the concrete parking block 100 as shown in FIG. 4. In the second embodiment, the parking block adhesive 10 is internally applied to the first lateral end 1 and the second lateral end 2 in addition to the inner surface 4 of the longitudinal enclosure 3.

The longitudinal enclosure 3 can be made of, but is not limited to, the following materials. One such material is high-density polyethylene (HDPE), Thermoplastic Poly-Olefin (TPO) or Acrylonitrile Butadiene Styrene (ABS). HDPE, TPO or ABS allows the longitudinal enclosure 3 to be lightweight, durable and able withstand weathering processes. Additionally, the longitudinal enclosure 3 can also be made of foam and resin. The foam and resin eliminates the chance of the concrete parking block 100 being damaged when run over by a vehicle. The foam and resin is lighter than HDPE, TPO and ABS. Due to the properties of foam and resin, the concrete parking block 100 can be completely replaced by a block made of foam and resin. The protective cover can also be made of cast stone. In accordance to the standard size of the concrete parking block 100, when the present invention is made of cast stone, it weighs less than 100 pounds. Regardless of the material used to construct the present invention, the outer surface 5 of the longitudinal enclosure 3 is designed to have a rough texture. The rough texture is important in terms of safety and also in terms of convenience if an advertisement is applied to the outer surface 5. As an example, the rough texture minimizes the risk of slipping when the outer surface 5 is wet. On the other hand, if the advertisement is applied onto the outer surface 5 with an adhesive, the adhesive can create a better bond with the rough texture. As a result, the advertisement is bonded to the outer surface securely.

A reflective coating 11 is applied on the present invention to increase visibility. Increased visibility is especially beneficial during low light conditions such as at night time. In order to so, the present invention can be covered in phosphorescent material such as a luminous paint. To increase visibility during the day, the present invention can be alternatively coated in fluorescent material. In the first embodiment, the reflective coating 11 is applied on the outer surface 5 of the longitudinal enclosure 3. In the second embodiment, the reflective coating 11 is also externally applied on the first lateral end 1 and the second lateral end 2.

In another embodiment, the protective cover can be used on a concrete parking block 100 that has a different cross-sectional shape than the concrete parking block 100 illustrated in the figures. The cross-sectional shape of the concrete parking block 100 can be, but is not limited to, rectangular, triangular, and semi-circular.

Figure 8:
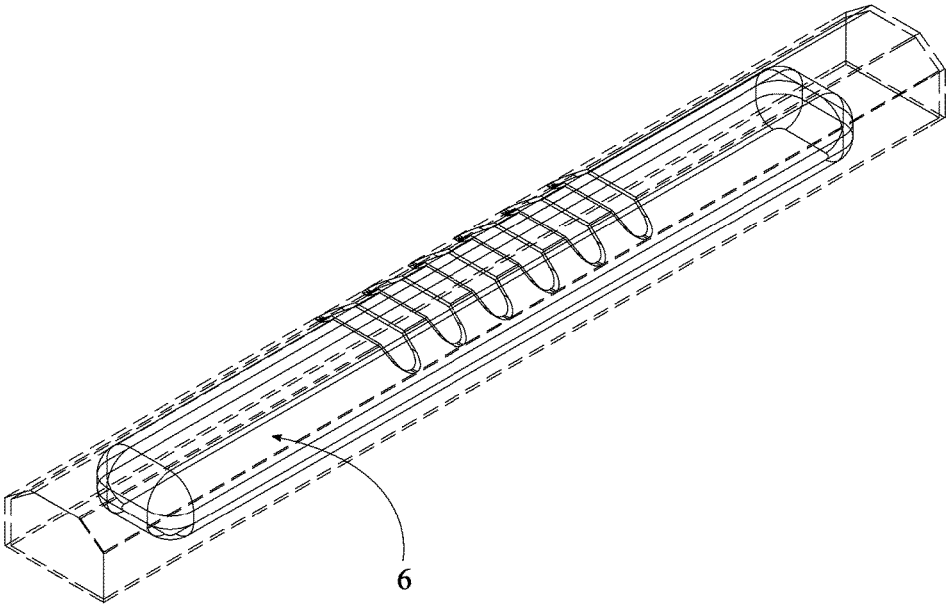
FIG. 8 is an isometric wire frame view of the present invention, wherein the present invention encloses the water bladder.
Figure 9:
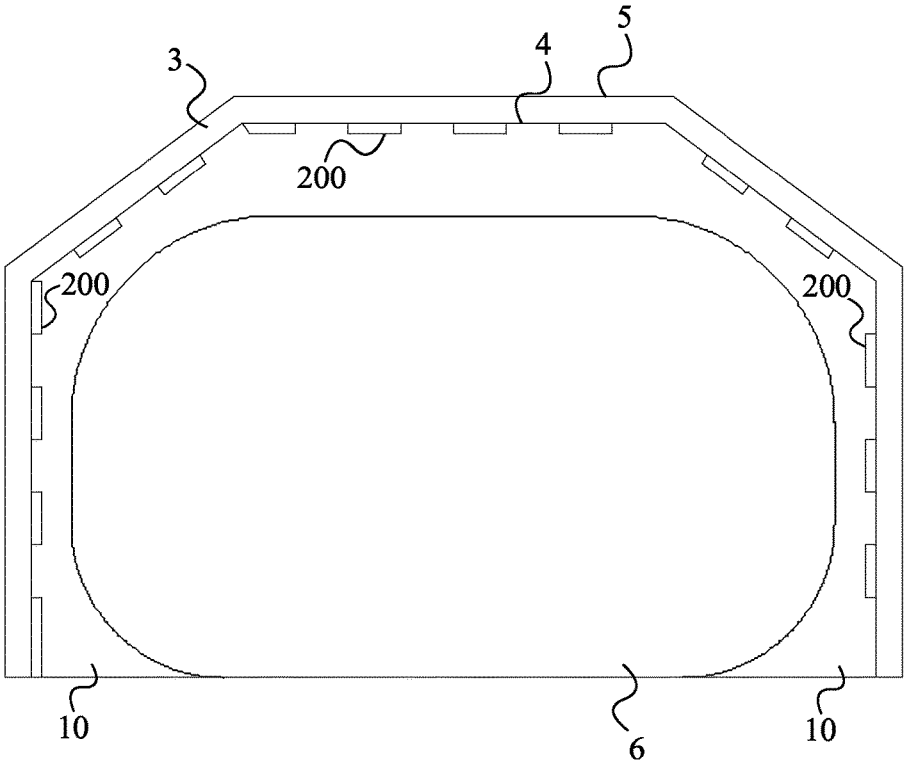
FIG. 9 is a cross sectional wire frame view of the present invention, wherein the present invention encloses the water bladder.
Figure 10:
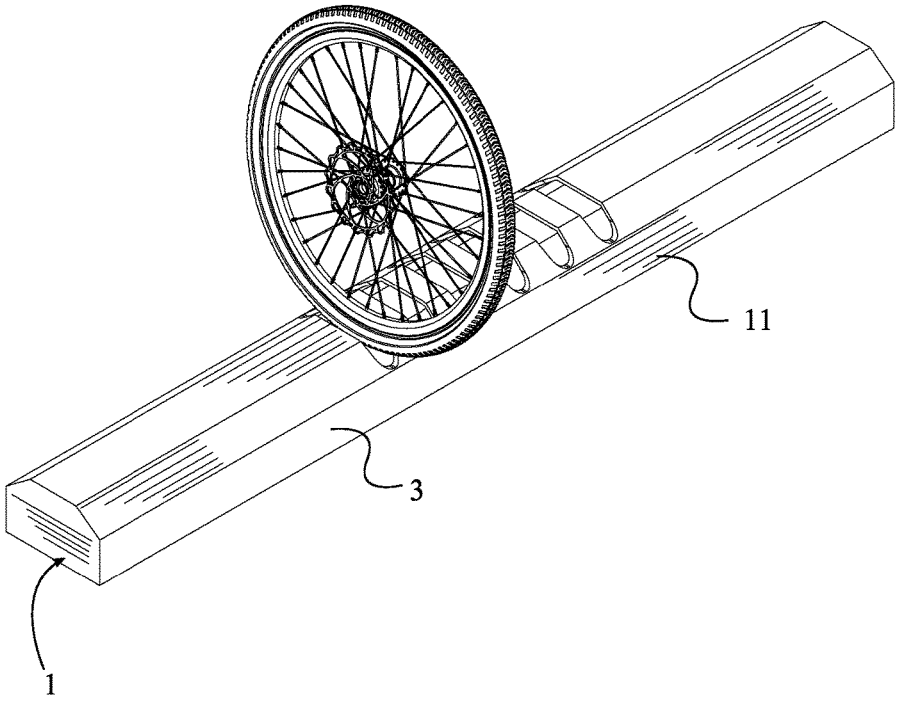
FIG. 10 is a perspective view of the present invention, wherein a bicycle wheel is inserted into one of the V-shaped slots.

In another embodiment, the present invention can be utilized as a bicycle stand as illustrated in FIGS. 7-10. In order to do so, the longitudinal enclosure 3 comprises a plurality of V-shaped slots 7. The plurality of V-shaped slots 7 is perpendicularly integrated into the longitudinal enclosure 3. As seen in FIG. 10, the user can place a bicycle wheel into any of the plurality of V-shaped slots 7. Furthermore, the plurality of V-shaped slots 7 is distributed along the longitudinal enclosure 3 allowing multiple bicycle wheels to be placed within a limited space. In contrast to enclosing a concrete parking block 100, this embodiment encloses a water bladder 6 as seen in FIG. 8 and FIG. 9. The water bladder 6 is conformedly adjoined to the inner surface 4 of the longitudinal enclosure 3 utilizing parking block adhesive 10. In this instance, the water bladder 6 is utilized to provide additional weight such that the present invention remains stationary. This embodiment is especially beneficial to be used in residential garages.

Figure 11A:
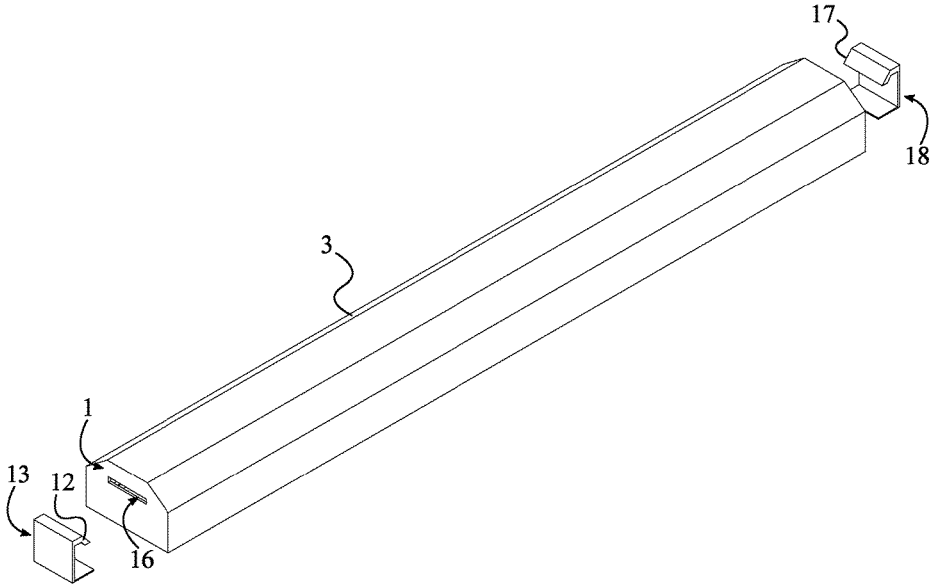
FIG. 11A is a perspective view of the present invention, wherein the present invention is removably attached to the concrete parking block.
Figure 11B:
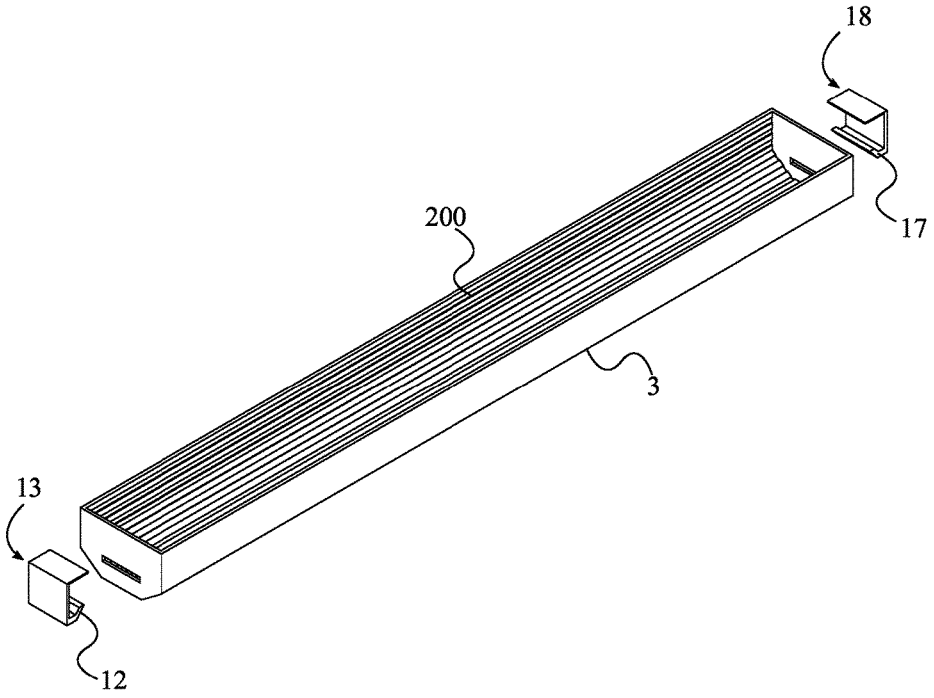
FIG. 11B is a bottom perspective view of the present invention, wherein the present invention is removably attached to the concrete parking block.
Figure 12:
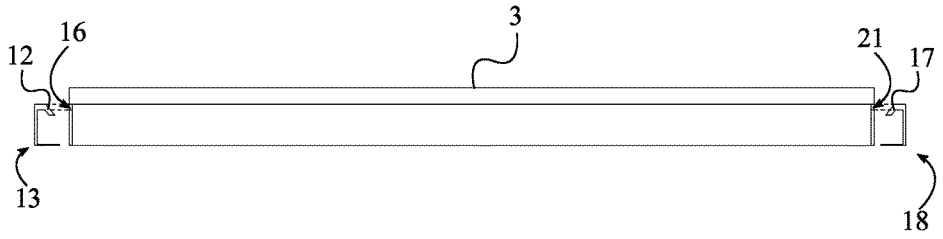
FIG. 12 is a side view of the present invention, wherein the present invention is removably attached to the concrete parking block.
Figure 13:
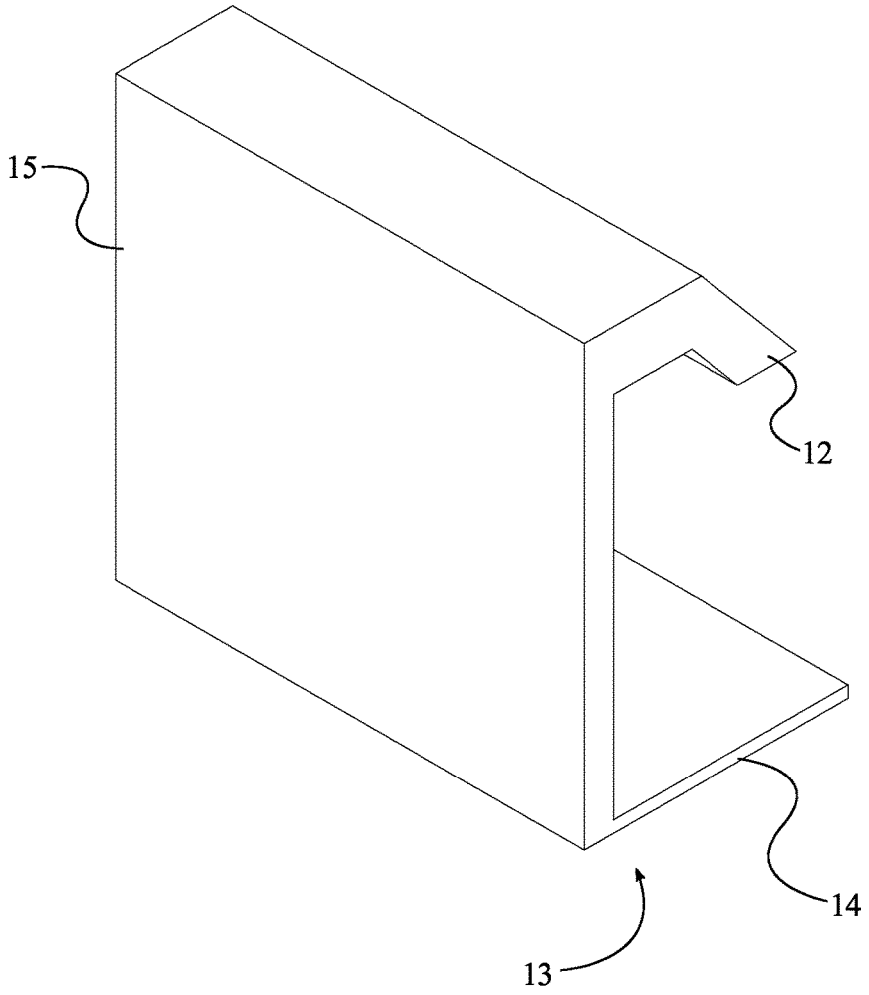
FIG. 13 is a perspective view of the first hook and the first angle.
Figure 14:
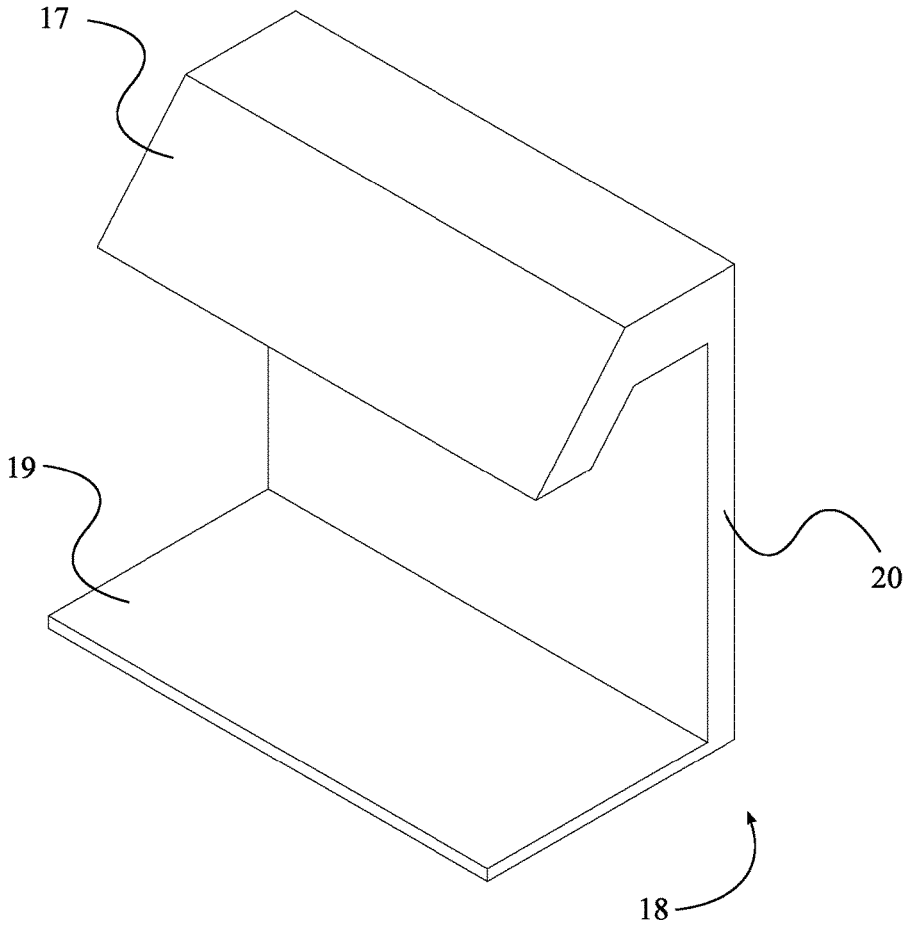
FIG. 14 is a perspective view of the second hook and the second angle.

The present invention can be temporarily mounted on the concrete parking block 100 in another embodiment of the present invention. In order to be temporarily attached, the present invention comprises a first hook 12, a first angle 13, and a first hook receiving slot 16. The first angle 13 comprises a first insert leg 14 and a first extension leg 15. As seen in FIG. 13, the first insert leg 14 is connected perpendicular and adjacent to the first extension leg 15 creating an L-shape that conforms to the first lateral end 1 of the present invention. The first hook receiving slot 16 traverses through the first lateral end 1 when the first lateral end 1 is a closed end. The first hook 12, which is connected adjacent to the first extension leg 15 and opposite to the first insert leg 14, is engaged into the first hook receiving slot 16. When engaged, the first extension leg 15 is pressed against the first lateral end 1 such that the first insert leg 14 is positioned adjacent to the longitudinal enclosure 3. In order to press the first extension leg 15 against the first lateral end 1, the first insert leg 14 is forced into a base of the concrete parking block 100. Hammering or other comparable methods can be utilized to force the first insert leg 14 into the base of the concrete parking block 100. Similar to securing the first lateral end 1 with the first hook 12, the first angle 13, and the first hook receiving slot 16, the present invention utilizes a second hook 17, a second angle 18, and a second hook receiving slot 21 to secure the longitudinal enclosure 3 at the second lateral end 2. Moreover, similar to the first angle 13, the second angle 18 comprises a second insert leg 19 and a second extension leg 20 which creates an L-shape when connected together as seen in FIG. 14. More specifically, the second insert leg 19 is connected perpendicular and adjacent to the second extension leg 20. The second hook 17 is connected adjacent to the second extension leg 20 and opposite to the second insert leg 19 so that the user can conveniently engage the second hook 17 in the second hook receiving slot 21. Similar to the first hook receiving slot 16 traversing through the first lateral end 1, the second hook receiving slot 21 traverses through the second lateral end 2. Therefore, when the second hook 17 is engaged in the second hook receiving slot 21, a secure connection is established between the present invention and the concrete parking block 100. When engaged, the second extension leg 20 is pressed against the second lateral end 2. Moreover, the second insert leg 19 is positioned adjacent the longitudinal enclosure 3. Similar to forcing the first insert leg 14 into the bottom surface of the concrete parking block 100, the second insert leg 19 is also forced towards the bottom surface of the concrete parking block 100. FIG. 11A, FIG. 11B, and FIG. 12 illustrate the longitudinal enclosure 3 being secured with the use of the first hook 12, the first angle 13, the second hook 17, and the second angle 18.

Although the invention has been explained in relation to its preferred embodiment, it is to be understood that many other possible modifications and variations can be made without departing from the spirit and scope of the invention as hereinafter claimed.

What is claimed is:

1. A cover for a concrete parking block comprising:
a first lateral end;
a second lateral end;
a longitudinal enclosure;
a parking block adhesive;
a plurality of protrusions;
the longitudinal enclosure comprising an inner surface, an outer surface, a first contact edge and a second contact edge;
the first lateral end and the second lateral end being positioned opposite to each other along the longitudinal enclosure;
the longitudinal enclosure being perimetrically connected around the first lateral end from the first contact edge to the second contact edge;
the longitudinal enclosure being perimetrically connected around the second lateral end from the first contact edge to the second contact edge;
the plurality of protrusions being positioned along the longitudinal enclosure;
the plurality of protrusions being connected adjacent and across the inner surface;
the parking block adhesive being layered across the inner surface and amongst the plurality of protrusions;
the plurality of protrusions each longitudinally extending along the longitudinal enclosure from the first lateral end to the second lateral end;
a hook;
an extension leg;
an insert leg;
a hook receiving slot;
the insert leg being connected perpendicular and adjacent to the extension leg;
the hook being connected adjacent to the extension leg, opposite to the insert leg;
the first and second lateral ends each being a closed end;
the hook receiving slot traversing through one of the first and second lateral ends;
the hook being engaged into the hook receiving slot;
the extension leg being pressed against the one of the first and second lateral ends; and
the insert leg being positioned adjacent to the longitudinal enclosure.

2. The cover for a concrete parking block as claimed in claim 1 further comprising:
the parking block adhesive being internally applied to the first lateral end.

3. The cover for a concrete parking block as claimed in claim 1 further comprising:
a reflective coating; and
the reflective coating being externally layered onto the first lateral end.

4. The cover for a concrete parking block as claimed in claim 1 further comprising:
the parking block adhesive being internally applied to the second lateral end.

5. The cover for a concrete parking block as claimed in claim 1 further comprising:
a reflective coating;
the reflective coating being externally layered onto the second lateral end.

6. The cover for a concrete parking block as claimed in claim 1 further comprising:
the longitudinal enclosure being made of a material selected from the group consisting of high-density polyethylene, thermoplastic polyolefin, and Acrylonitrile Butadiene styrene.

7. The cover for a concrete parking block as claimed in claim 1 further comprising:
the longitudinal enclosure being made of a foam and resin material.

8. The cover for a concrete parking block as claimed in claim 1 further comprising:
a reflective coating; and
the reflective coating being layered onto the outer surface.

9. The cover for a concrete parking block as claimed in claim 1 further comprising:
the inner surface being adapted to be conformedly adjoined with a parking block by the parking block adhesive.

10. The cover for a concrete parking block as claimed in claim 2 further comprising:
the hook comprising a first hook;
the hook receiving slot comprising a first hook receiving slot;
the insert leg comprising a first insert leg;
the extension leg comprising a first extension leg;
the first insert leg being connected perpendicular and adjacent to the first extension leg;
the first hook being connected adjacent to the first extension leg, opposite to the first insert leg;
the first hook receiving slot traversing through the first lateral end;
the first hook being engaged into the first hook receiving slot;
the first extension leg being pressed against the first lateral end; and
the first insert leg being positioned adjacent to the longitudinal enclosure.

11. The cover for a concrete parking block as claimed in claim 4 further comprising:

the hook comprising a second hook;

the hook receiving slot comprising a second hook receiving slot;

the insert leg comprising a second insert leg;

the extension leg comprising a second extension leg;

the second insert leg being connected perpendicular and adjacent to the second extension leg;

the second hook being connected adjacent to the second extension leg, opposite to the second insert leg;

the second hook receiving slot traversing through the second lateral end;

the second hook being engaged in the second hook receiving slot;

the second extension leg being pressed against the second lateral end; and the second insert leg being positioned adjacent to the longitudinal enclosure.

* * * * *